US010562294B2

(12) United States Patent
Miyata et al.

(10) Patent No.: US 10,562,294 B2
(45) Date of Patent: Feb. 18, 2020

(54) INKJET RECORDING APPARATUS

(71) Applicant: KYOCERA Document Solutions Inc., Osaka (JP)

(72) Inventors: Mitsuko Miyata, Osaka (JP); Erika Tanaka, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 16/215,035

(22) Filed: Dec. 10, 2018

(65) Prior Publication Data

US 2019/0193392 A1 Jun. 27, 2019

(30) Foreign Application Priority Data

Dec. 27, 2017 (JP) ..... 2017-251450

(51) Int. Cl.
*B41J 2/045* (2006.01)
*B41J 2/14* (2006.01)
*B41J 11/00* (2006.01)

(52) U.S. Cl.
CPC ..... *B41J 2/04505* (2013.01); *B41J 2/0458* (2013.01); *B41J 2/14088* (2013.01); *B41J 11/002* (2013.01); *B41J 2002/14185* (2013.01)

(58) Field of Classification Search
CPC .. B41J 2/04505; B41J 2/0458; B41J 2/14088; B41J 11/002
See application file for complete search history.

(56) References Cited

U.S. PATENT DOCUMENTS 8,240,839 B2 * 8/2012 Yamanobe ..... B41J 2/0057 347/101
2016/0243837 A1 8/2016 Usui

FOREIGN PATENT DOCUMENTS

JP 2016-155240 A 9/2016

* cited by examiner

*Primary Examiner* — Thinh H Nguyen
(74) *Attorney, Agent, or Firm* — Stein IP, LLC

(57) ABSTRACT

An inkjet recording apparatus has a recording head, a thermal head, and a heat control portion. The recording head has an ink discharge surface. The thermal head is arranged opposite the ink discharge surface across a recording medium conveying passage and heats a recording medium. In the thermal head, a plurality of element arrays each formed of a plurality of heating elements arrayed in the recording medium conveying direction are provided in the width direction. The heat control portion makes at least part of the heating elements in the element arrays that correspond to the ink discharge ports that discharge ink generate heat.

6 Claims, 7 Drawing Sheets

INKJET RECORDING APPARATUS

INCORPORATION BY REFERENCE

This application is based upon and claims the benefit of priority from the corresponding Japanese Patent Application No. 2017-251450 filed on Dec. 27, 2017, the entire contents of which are incorporated herein by reference.

BACKGROUND

The present disclosure relates to an inkjet recording apparatus incorporating a recording head discharging ink onto a recording medium and a thermal head heating the recording medium.

As a recording apparatus printing on a recording medium such as paper, film, and cloth, inkjet recording apparatuses discharging ink to form an image are widely used because they can form a high-resolution image.

In such an inkjet recording apparatus, ink discharged on a recording medium can mix with ink discharged from a recording head on the downstream side in the recording medium conveying direction, and attach (move) to a conveying roller pair arranged on the downstream side in the recording medium conveying direction. One possible way to prevent such mixture and attachment is to provide a heating device heating ink on a recording medium near the downstream side of the recording head.

SUMMARY

According to one aspect of the present disclosure, an inkjet recording apparatus includes a recording head, a thermal head, and a heat control portion. The recording head has an ink discharge surface in which a plurality of ink discharge ports discharging ink onto a recording medium are open. The thermal head is arranged opposite the ink discharge surface across a recording medium conveying passage and heats a recording medium. The heat control portion controls the thermal head. The thermal head is provided with a plurality of element arrays in the width direction perpendicular to the recording medium conveying direction. The element arrays are each formed of a plurality of heating elements arrayed in the recording medium conveying direction, and each correspond to one or more ink discharge ports. The element arrays are arranged at least on the downstream side, in the recording medium conveying direction, of the landing position where the ink discharged from the ink discharge ports lands on the recording medium. The heat control portion can make the plurality of heating elements generate heat selectively and makes at least part of the heating elements in the element arrays that correspond to the ink discharge ports that discharge ink generate heat. The heat control portion changes at least one of the amount of heat generated in a heating region in which the heating elements in the element arrays are made to generate heat and the length of the heating region in the recording medium conveying direction according to how quickly the ink on the recording medium dries.

Further features and advantages of the present disclosure will become apparent from the description of embodiments given below.

DETAILED DESCRIPTION

Hereinafter, with reference to the accompanying drawings, embodiments of the present disclosure will be described.

Figure 1:
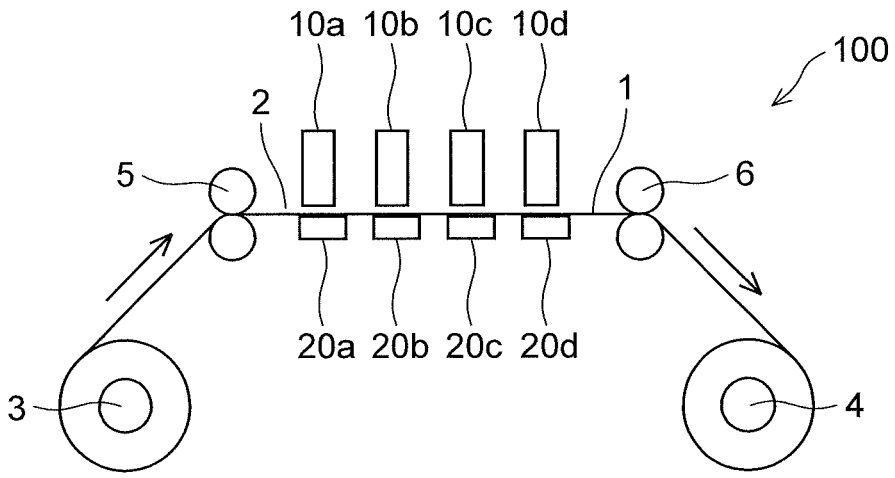
FIG. 1 is a schematic diagram showing an overall structure of an inkjet recording apparatus according to one embodiment of the present disclosure.

As shown in FIG. 1, an inkjet recording apparatus 100 according to one embodiment of the present disclosure serves to perform image formation by discharging ink onto a recording medium 1, and includes a plurality of (here, four) recording heads 10*a*, 10*b*, 10*c*, and 10*d* along a recording medium conveying passage 2.

In this embodiment, the recording medium 1 is wound in a roll. As the recording medium 1, resin film, paper (such as plain paper or glossy paper), cloth, or the like can be used.

The inkjet recording apparatus 100 includes a feeding rotary shaft 3 which feeds out the recording medium 1 out of a roll, a winding rotary shaft 4 which winds up the recording medium 1 having undergone image formation back into a roll, a conveying roller pair 5 which conveys the recording medium 1 to recording heads 10*a* to 10*d*, a conveying roller pair 6 which conveys the recording medium 1 having undergone image formation to the winding rotary shaft 4, and a plurality of (here, four) thermal heads 20*a*, 20*b*, 20*c*, and 20*d* which heat the recording medium 1.

The recording medium 1 fed out from the feeding rotary shaft 3 undergoes image formation by the recording heads 10*a* to 10*d* and is dried in some degree (preliminarily drying) while it passes across the thermal heads 20*a* to 20*d*; then the recording medium 1 is wound up by the winding rotary shaft 4. The ink on the surface of the recording medium 1 is dried in some degree (preliminarily drying) by the thermal heads 20*a* to 20*d*; the ink is hardly likely to attach to the conveying roller pair 6, or to the reverse side of the recording medium 1 after winding-up; even so, a heating device may be provided on the downstream side of the thermal head 20*d* in the recording medium conveying direction as necessary.

The recording heads 10*a* to 10*d* are arranged at such a height as to leave a predetermined gap relative to the top face of the thermal heads 20*a* to 20*d*, and are formed so as to extend along the width direction (the direction perpendicular to the plane of FIG. 1) perpendicular to the recording medium conveying direction.

Figure 2:
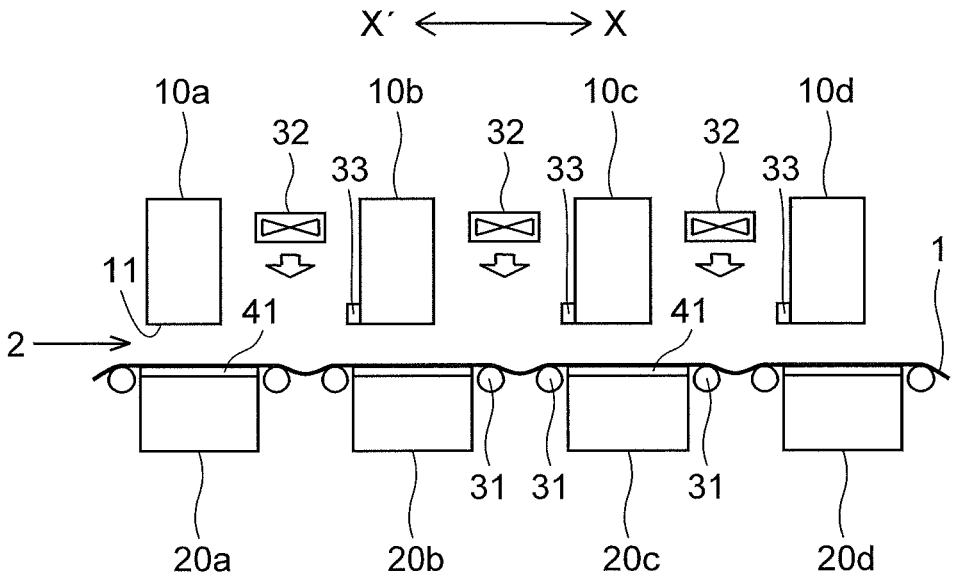
FIG. 2 is a diagram showing a structure of and around recording heads and thermal heads in the inkjet recording apparatus according to the one embodiment of the present disclosure.
Figure 3:
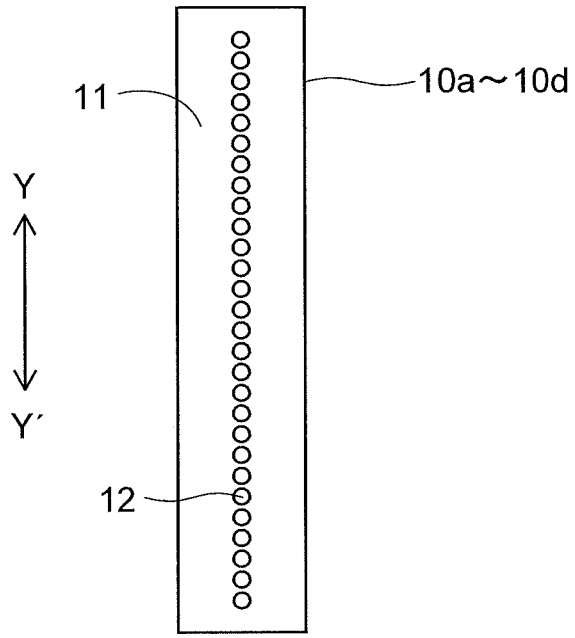
FIG. 3 is a diagram, as seen from an ink discharge surface side, of the recording head in the inkjet recording apparatus according to the one embodiment of the present disclosure.

As shown in FIGS. 2 and 3, ink discharge surfaces 11 of the recording heads 10*a* to 10*d* are provided with a plurality of ink discharge ports 12 with a predetermined pitch in the width direction (the direction indicated by allows Y and Y', the main scanning direction). The plurality of ink discharge ports 12 do not necessarily have to be arranged in a straight line in the width direction; instead, they may be arranged in a staggered array, or in a line inclined with respect to the width direction.

The recording heads 10*a* to 10*d* correspond to, for example, cyan, magenta, yellow, and black, respectively, and discharge aqueous ink of the different colors from the ink discharge ports 12. Thereby, a color image is formed on the recording medium 1.

Figure 4:
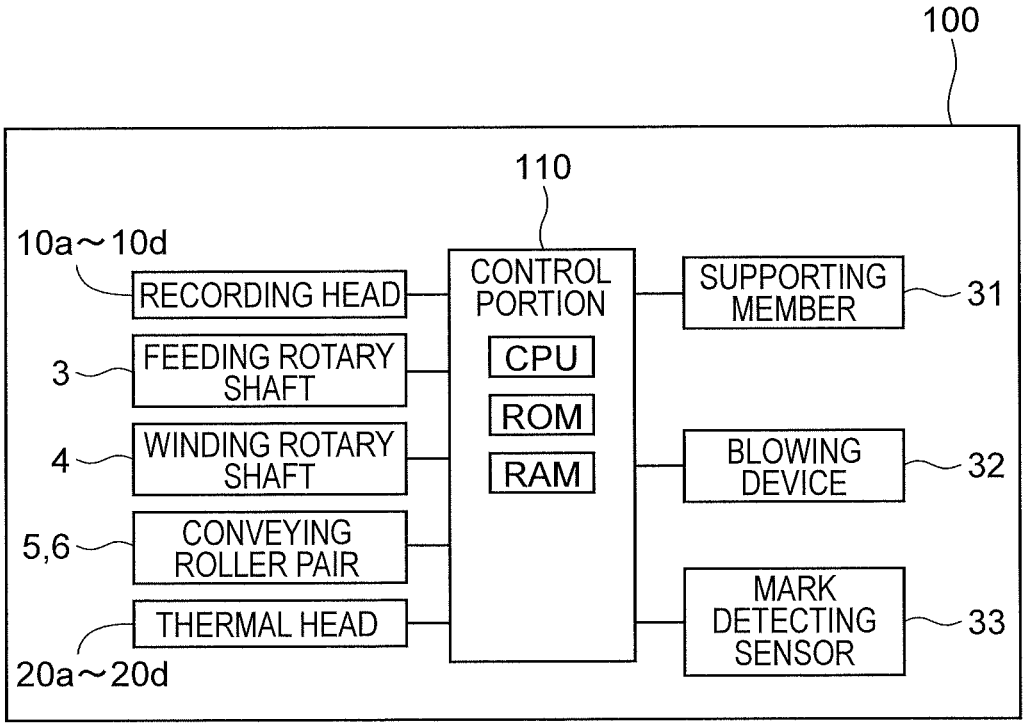
FIG. 4 is a block diagram illustrating control channels in the inkjet recording apparatus according to the one embodiment of the present disclosure.

As shown in FIG. 4, a control portion 110 in the inkjet recording apparatus 100 is composed of a CPU (central processing unit), a ROM (read-only memory), a RAM (random-access memory), and the like. The control portion 110 can control the recording heads 10*a* to 10*d*, the feeding rotary shaft 3, the winding rotary shaft 4, the conveying roller pairs 5 and 6, the thermal heads 20*a* to 20*d*, and the like, and can control the whole inkjet recording apparatus 100. The control portion 110 can also control a supporting member 31 and a blowing device 32, which will be described later, and can communicate with a mark detecting sensor 33.

The ROM stores data and the like which are not changed when the inkjet recording apparatus 100 is in use, such as a program for control of the inkjet recording apparatus 100, values necessary for control, and the like. The RAM stores necessary data which is generated in the process of controlling the inkjet recording apparatus 100, data which is temporarily needed to control the inkjet recording apparatus 100, and the like.

The control portion 110 is configured to be able to communicate with an operation panel or a personal computer (neither is illustrated) to which information and the like related to the type of the recording medium 1 is entered by a user. The control portion 110 acquires (receives) information from the operation panel or the personal computer. The control portion 110, for example, determines the amount of ink discharged from each of the ink discharge ports 12 according to image data received from a personal computer, and determines the transport speed of the recording medium 1 according to the type of the recording medium 1, a setting for printing speed made by a user, and the like.

In this embodiment, as shown in FIG. 2, the thermal heads 20*a* to 20*d* are arranged opposite the ink discharge surfaces 11 of the recording heads 10*a* to 10*d*, respectively, across the recording medium conveying passage 2, and heat the recording medium 1 from the reverse side (the side opposite from the recording surface).

The recording heads 10*a* to 10*d* are arranged at predetermined intervals along the recording medium conveying direction (the direction indicated by arrow X), and also the thermal heads 20*a* to 20*d* are arranged at predetermined intervals along the recording medium conveying direction. On the upstream and downstream sides, respectively, of each of the thermal heads 20*a* to 20*d* in the recording medium conveying direction, supporting members 31 supporting the recording medium 1 are provided. That is, between the thermal heads 20*a* to 20*d*, at least one (here, two) supporting member 31 is arranged. The uppermost position of the supporting member 31 is at the same height as or at a height slightly lower than the top face of the thermal heads 20*a* to 20*d* (the bottom face of the recording medium conveying passage 2; in this embodiment, the top face of a slide layer 41, which will be described later).

The supporting member 31 is formed by a conveying roller rotating with a rotary driving force from a driving source (unillustrated). Instead, the supporting member 31 may be formed by a driven roller, or may be formed by a guide member guiding the recording medium 1.

Between the recording heads 10*a* to 10*d*, blowing devices 32 are provided which each comprise a fan sending air to the recording medium 1 from between the recording heads 10*a* to 10*d*. Thus, with stream of air, the recording medium 1 makes close contact with the top face of the thermal heads 20*a* to 20*d* (the bottom face of the recording medium conveying passage 2). Although, in FIG. 2, a total of three blowing devices 32 are provided one between every two adjacent recording heads 10*a* to 10*d*, it is not necessary to arrange a blowing device 32 between every two adjacent recording heads 10*a* to 10*d*. Instead, for example, ducts may be arranged one between every two adjacent recording heads 10*a* to 10*d*, and only one blowing device 32 sending air to all those ducts may be provided. Even in this case, it is possible to send air to the recording medium 1 from between the recording heads 10*a* to 10*d*. In a case where the inkjet recording apparatus 100 is large (for example, in a case where the intervals between the recording heads 10*a* to 10*d* are larger than 50 cm), the recording medium 1 makes close contact with the top face of the thermal head 20*a* to 20*d* (the bottom face of the recording medium conveying passage 2) under the self-weight of the recording medium 1, and thus it is not necessary to provide a blowing device 32.

In a case where the supporting members 31 are arranged between the thermal heads 20*a* to 20*d*, it is possible to prevent the recording medium 1 from sagging down between the thermal heads 20*a* to 20*d*. However in a case where the blowing devices 32 are arranged, depending on the thickness and stiffness of the recording medium 1, the recording medium 1 may sag down between the thermal heads 20*a* to 20*d*. In this case, the recording medium 1 reaches the thermal heads 20*b*, 20*c*, and 20*d* with a delay corresponding to the amount of sag, so that color misalignment results.

Figure 5:
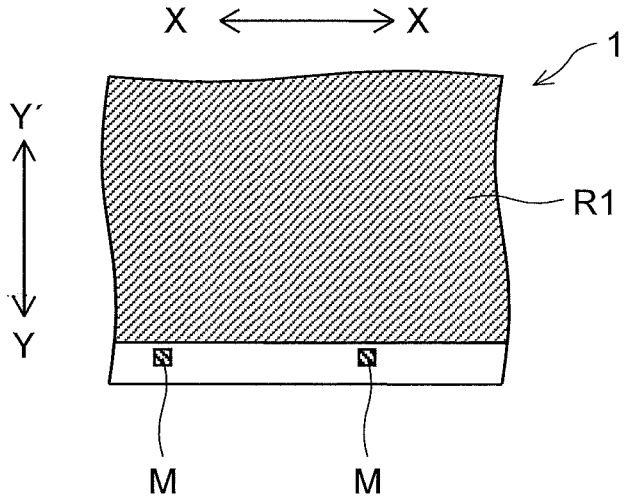
FIG. 5 is a diagram showing a recording medium having a reference mark printed on it by the inkjet recording apparatus according to the one embodiment of the present disclosure.

As a solution, in this embodiment, the recording head (the most-upstream head) 10*a* arranged most upstream out of the recording heads 10*a* to 10*d* is configured to print a reference mark M (see in FIG. 5) for timing correction on the recording medium 1. The reference mark M is printed, for example, with a size of 2 mm×2 mm and at a pitch of a few centimeters, outside a printing region R1. In FIG. 5, to facilitate understanding, the reference mark M and the printing region R1 are indicated by hatching. Each of the recording heads 10*b* to 10*d* other than the recording heads 10*a* is provided with a reflective or transmissive mark detecting sensor (mark detecting portion) 33 detecting the reference mark M. The results of detection by the mark detecting sensors 33 are transmitted to the control portion 110.

Based on the detection timing with which the mark detecting sensors 33 detected the reference mark M, the control portion (head control portion) 110 corrects ink discharge timing of the recording heads 10*a* to 10*d*. Accordingly, even when the recording medium 1 sags down between the thermal heads 20*a* to 20*d*, it is possible to prevent color misalignment.

On the top face of the thermal heads 20*a* to 20*d* (the face facing the recording heads 10*a* to 10*d*), a slide layer 41 is provided across which the recording medium 1 slides while in contact with it. Thus, it is possible to prevent the recording medium 1 from being scratched while passing across the thermal heads 20*a* to 20*d*.

The slide layer 41 is formed of a thin-film hard glass plate in this embodiment. The slide layer 41 is formed with a thickness of 100 μm or less, and is more preferably formed with a thickness of 20 μm or less.

Instead, the slide layer 41 may be formed of resin. In this case, from the perspective of heat resistance, the slide layer 41 is preferably formed of polyimide or polyamide-imide. Using polyimide or polyamide-imide allows the slide layer 41 to be easily formed with a thickness of 20 μm or less. To reduce the friction coefficient of the slide layer 41 on the recording medium 1, the face (top face) of the slide layer 41 on which it makes contact with the recording medium 1 may be coated with fluorine resin, such as PTFE (polytetrafluoroethylene), PFA (tetrafluoroethylene-perfluoroalkyl vinyl ether copolymer), or FEP (tetrafluoroethylene-hexafluoropropylene copolymer).

Figure 6:
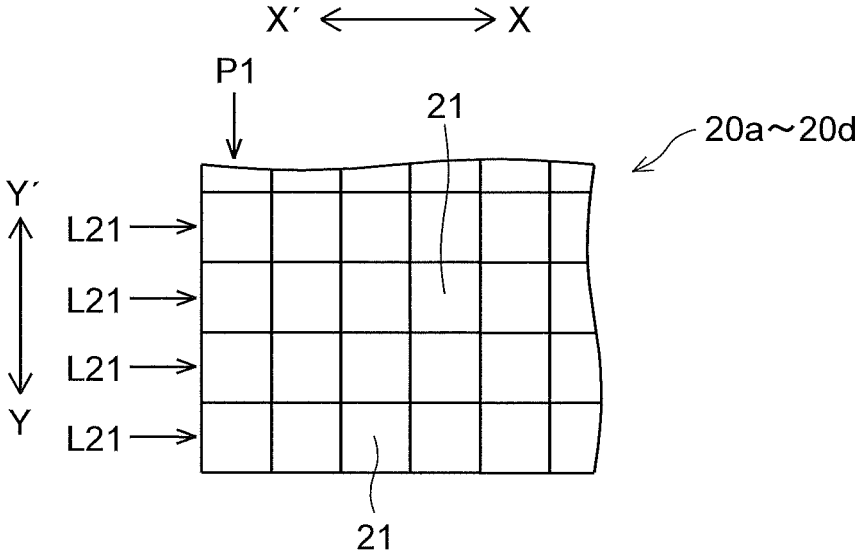
FIG. 6 is a diagram showing a structure of the thermal head in the inkjet recording apparatus according to the one embodiment of the present disclosure.

In this embodiment, the thermal heads 20*a* to 20*d* are provided with a plurality of heating elements 21 as shown in FIG. 6. The heating elements 21 are arrayed in the recording medium conveying direction (the direction indicated by arrow X), so that element arrays L21 are formed which extends in the recording medium conveying direction. A plurality of element arrays L21 are formed in the width direction (the direction indicated by allows Y and Y') so as to correspond to every one or more ink discharge ports 12 (see in FIG. 3).

The element array L21 is arranged at least on the downstream side, in the recording medium conveying direction (the direction indicated by arrow X), of a landing position P1 where the ink discharged from the ink discharge ports 12 land on the recording medium 1 (the position right under the ink discharge ports 12). Here, the element array L21 is arranged from the landing position P1 (or a position slightly on the upstream side of the landing position P1 in the recording medium conveying direction (the direction indicated by arrow X')) to the downstream side in the recording medium conveying direction (the direction indicated by arrow X).

Each of the heating elements 21 has a heating resistive element, a thin-film transistor, an individual electrode, a common electrode, and the like (neither is illustrated), and the control portion (heat control portion) 110 can selectively make a plurality of heating elements 21 generate heat.

The control portion 110 can, by making part of the heating elements 21 in the element arrays L21 that correspond to the ink discharge ports 12 that discharge ink generate heat, dry the ink on the recording medium 1 in some degree (preliminarily drying) before it reaches the following recording heads 10*b* to 10*d* and the conveying roller pair 6. Here, aqueous ink is used, and thus the control portion 110 sets the amount of heat generated by the heating elements 21 such that the top face of the recording medium 1 (the face at which ink lands) is at about 100 degrees.

There are various methods for setting a heating region R21 in which the heating element 21 is made to generate heat.

Figure 7:
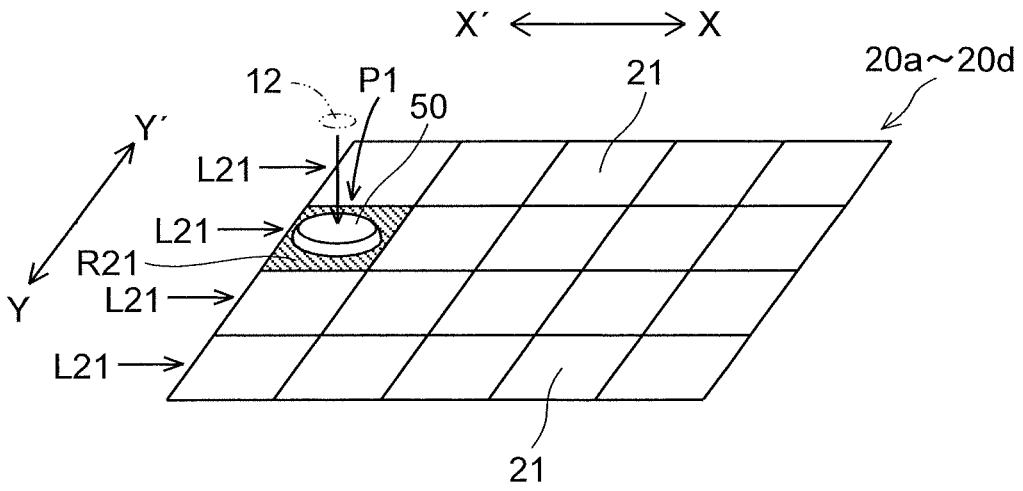
FIG. 7 is a diagram illustrating a method for setting a heating region on the thermal head in the inkjet recording apparatus according to the one embodiment of the present disclosure, showing an example in which only a heating element at a landing position is made to generate heat.

For example, as shown in FIG. 7, the control portion 110 can make only the heating element 21 at the landing position P1 generate heat. With this structure, when the ink 50 discharged from the ink discharge ports 12 lands on the recording medium 1, the ink 50 on the recording medium 1 is preliminarily dried. To facilitate understanding, in FIGS. 7 to 11, the heating region R21 in which the heating element 21 is made to generate heat is indicated by hatching and the recording medium 1 is omitted.

Figure 8:
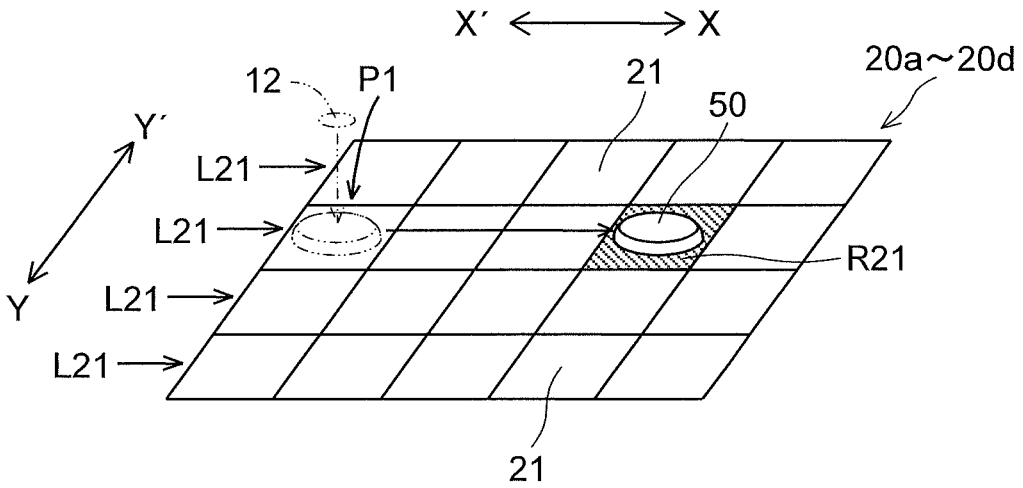
FIG. 8 is a diagram illustrating a method for setting the heating region on the thermal head in the inkjet recording apparatus according to the one embodiment of the present disclosure, showing an example in which only the heating elements on the downstream side of the landing position in the recording medium conveying direction are made to generate heat.

As shown in FIG. 8, the control portion 110 can make only the heating elements 21 generate heat which are on the downstream side of the landing position P1 in the recording medium conveying direction (the direction indicated by arrow X). With this structure, when the ink 50 on the recording medium 1 passes across the heating region R21, the ink 50 on the recording medium 1 is preliminarily dried.

Figure 9:
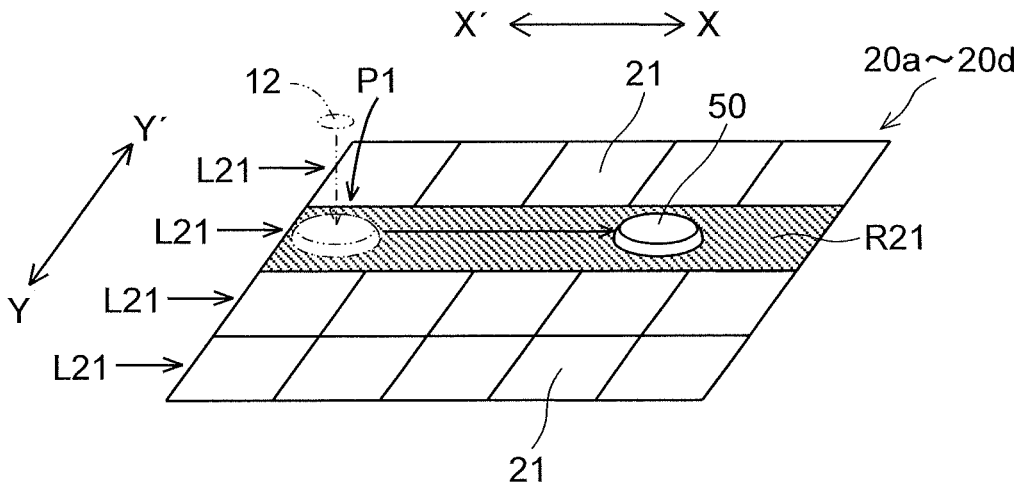
FIG. 9 is a diagram illustrating a method for setting the heating region on the thermal head in the inkjet recording apparatus according to the one embodiment of the present disclosure, showing an example in which the heating elements in a predetermined range extending from the landing position toward the downstream side in the recording medium conveying direction are made to generate heat.

As shown in FIG. 9, the control portion 110 can make the heating elements 21 generate heat in a predetermined range extending from the landing position P1 (or a position on the downstream side of the landing position P1 in the recording medium conveying direction) toward the downstream side in the recording medium conveying direction (at the right side in FIG. 9). That is, the control portion 110 can form the heating region R21 such that it extends in the recording medium conveying direction. With this structure, the ink heating time can be made longer, and thus it is possible to suppress the amount of heat generated by each of the heating elements 21 accordingly. Here, it is possible, with the temperature of the top face of the recording medium 1 lowered to, for example, about 80 to 85 degrees, to preliminarily dry the recording medium 1; thus even when resin such as PP (polypropylene) having comparatively low heat resistance is used as the recording medium 1, it is possible to prevent the recording medium 1 from suffering heat shrinkage (heat distortion).

In the structure shown in FIGS. 7, 8, and 9, the control portion 110 makes the heating elements 21 generate heat with the heating region R21 kept at rest of a predetermined position.

Figure 10:
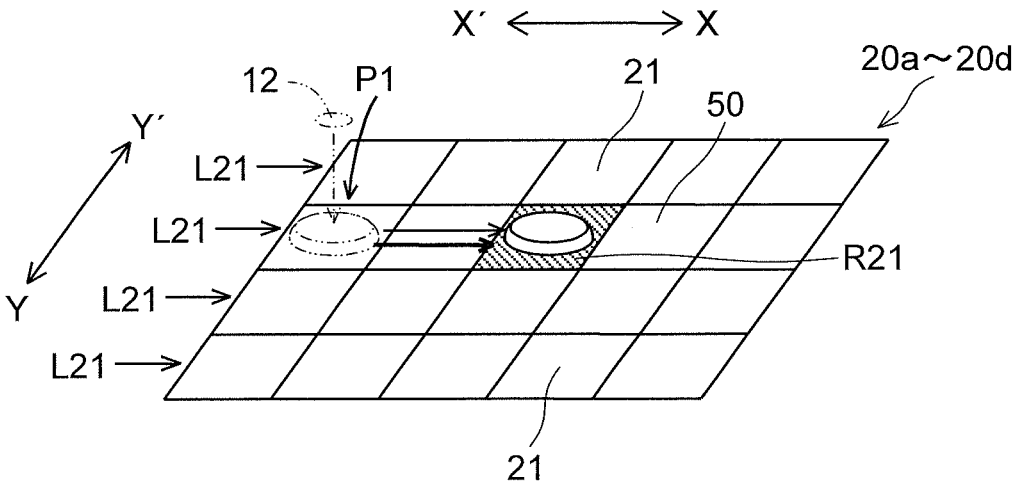
FIG. 10 is a diagram illustrating a method for setting the heating region on the thermal head in the inkjet recording apparatus according to the one embodiment of the present disclosure, showing an example in which the heating region is moved with the movement of the ink.
Figure 11:
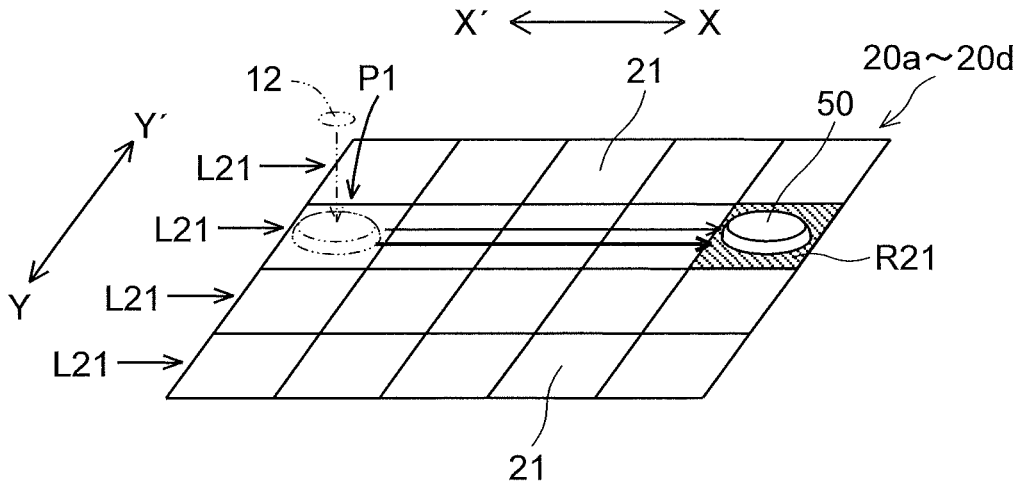
FIG. 11 is a diagram illustrating a method for setting the heating region on the thermal head in the inkjet recording apparatus according to the one embodiment of the present disclosure, showing a state where, from the state in FIG. 10, the ink and the heating region have been moved farther on the downstream side in the recording medium conveying direction.

As shown in FIGS. 10 and 11, the heating region R21 can be moved toward the downstream side in the recording medium conveying direction with the movement of the ink 50 on the recording medium 1. With this structure, as with in FIG. 9, the ink heating time can be made longer, and thus it is possible to suppress the amount of heat generated by each of the heating elements 21 accordingly. It is possible, with the temperature of the top face of the recording medium 1 lowered to, for example, about 80 degrees to 85 degrees, to preliminarily dry the recording medium 1. In FIGS. 10 and 11, the movement of the heating region R21 is indicated by a thick arrow.

Here, in this embodiment, the control portion 110 can change at least one of the amount of heat generated in the heating region R21 and the length of the heating region R21 in the recording medium conveying direction according to how quickly the ink 50 on the recording medium 1 dries.

Specifically, the control portion 110 can change at least one of the amount of heat generated in the heating region R21 and the length of the heating region R21 according to the amount of ink discharged from the ink discharge ports 12 (the amount of ink per dot). In this case, if the amount of ink discharged from the ink discharge ports 12 is large (if the ink 50 dries slowly), the control portion 110 increases the amount of heat generated in the heating region R21 or the length of the heating region R21. On the other hand, if the amount of ink discharged from the ink discharge ports 12 is small (if the ink 50 dries quickly), the control portion 110 reduces the amount of heat generated in the heating region R21 or the length of the heating region R21.

The control portion 110 can change at least one of the amount of heat generated in the heating region R21 and the length of the heating region R21 according to the type of the recording medium 1. In this case, for example, if the thickness of the recording medium 1 is large (if the ink dries slowly), the control portion 110 increases the amount of heat generated in the heating region R21 or the length of the heating region R21. On the other hand, if the thickness of the recording medium 1 is small (if the ink dries quickly), the control portion 110 reduces the amount of heat generated in the heating region R21 or the length of the heating region R21. For another example, if use is made of a recording medium 1 that has a smooth surface and that is rather impermeable by the ink 50, such as a label or a film (if the ink dries slowly), the control portion 110 increases the amount of heat generated in the heating region R21 or the length of the heating region R21. On the other hand, if use is made of a recording medium 1 that is easily permeable by the ink 50, such as a plain paper (if the ink dries quickly), the control portion 110 reduces the amount of heat generated in the heating region R21 or the length of the heating region R21.

In a case where the heat generation methods shown in FIGS. 7 to 11 are used, the control portion 110 can change the amount of heat generated in the heating region R21 according to how quickly the ink 50 on the recording medium 1 dries. In a case where the heat generation method shown in FIG. 9 is used, the control portion 110 can change the length of the heating region R21 in the recording medium conveying direction according to how quickly the ink 50 on the recording medium 1 dries.

In this embodiment, the control portion 110 can change at least one of the amount of heat generated in the heating region R21 and the length of the heating region R21 in the recording medium conveying direction according to the conveying speed of the recording medium 1.

In this case, if the conveying speed of the recording medium 1 is high (if printing operation is performed at high speed), the control portion 110 increases the amount of heat generated in the heating region R21 or the length of the heating region R21. On the other hand, if the conveying speed of the recording medium 1 is low (if printing operation is performed at low speed), the control portion 110 reduces the amount of heat generated in the heating region R21 or the length of the heating region R21.

In a case where any of the heat generation methods shown in FIGS. 7 to 11 is used, the control portion 110 can change the amount of heat generated in the heating region R21 according to the conveying speed of the recording medium 1. In a case where the heat generation method shown in FIG. 9 is used, the control portion 110 can change the length of the heating region R21 in the recording medium conveying direction according to the conveying speed of the recording medium 1.

In this embodiment, the heating region R21 is arranged approximately opposite a region where the ink (hereinafter, also referred to as an ink dot) 50 on the recording medium 1 passes. In the present specification, "a heating region is arranged approximately opposite a region where an ink dot on a recording medium passes." means that a heating region is so arranged that 50% or more of the area of the ink dot passes across the heating region. Here, the heating region R21 is so arranged that 80% or more of the area of the ink dot 50 passes across the heating region R21. That is, the element arrays L21 of the thermal heads 20*a* to 20*d* are arranged with high accuracy with no displacement in the width direction (the direction indicated by allows Y and Y') relative to the ink discharge ports 12 of the recording heads 10*a* to 10*d*.

In this embodiment, the control portion 110 makes the heating region R21 generate heat in accordance with the timing with which the ink dot 50 on the recording medium 1 passes across the recording medium conveying passage 2. Specifically, the control portion 110 makes the heating region R21 generate heat with predetermined timing based on the conveying speed of the recording medium 1 and the distance from the landing position P1 to the heating region R21. The timing with which the heating region R21 is made to generate heat is corrected, as is the ink discharge timing described above, by the control portion 110 based on the timing with which the mark detecting sensors 33 detects the reference mark M.

For example, in a case where the heat generation method shown in FIG. 7 is used, the control portion 110 makes the heating region R21 generate heat when the ink 50 lands on the recording medium 1 (or slightly earlier than when the ink 50 lands with consideration given to the time required by the heating), and makes the heating in the heating region R21 stop just after the ink dot 50 has passed across the heating region R21.

In a case where the heat generation method shown in FIG. 8 is used, the control portion 110 makes the heating region R21 generate heat when the ink dot 50 reaches the heating region R21 (or slightly earlier than when the ink dot 50 reaches the heating region R21 with consideration given to the time required by the heating), and makes the heating in the heating region R21 stop just after the ink dot 50 has passed across the heating region R21.

In a case where the heat generation method shown in FIG. 9 is used, the control portion 110 makes the heating region R21 generate heat when the ink 50 lands on the recording medium 1 (or slightly earlier than when the ink 50 lands with consideration given to the time required by the heating), and makes the heating in the heating region R21 stop just after the ink dot 50 has passed across the heating region R21.

In a case where either of the heat generation methods shown in FIGS. 10 and 11 is used, the control portion 110 switches the heating elements 21 between ON and OFF sequentially such that the ink dot 50 is always located on the heating region R21, and makes the heating region R21 move toward the downstream side in the recording medium conveying direction at the same speed as the moving speed of the ink dot 50 (the conveying speed of the recording medium 1).

When the heating region R21 is made to generate heat in accordance with the timing with which the ink dot 50 passes, the control portion 110 makes the heating region R21 generate heat with the timing with which the ink dot 50 is arranged approximately opposite the heating region R21 generating heat. In the present specification, "an ink dot is arranged approximately opposite a heating region generating heat." means that 50% or more of the area of the ink dot passes across the heating region generating heat (is arranged to overlap the heating region generating heat). Here, the control portion 110 makes the heating region R21 generate heat with the timing with which 80% or more of the area of the ink dot 50 passes across the heating region R21 in heating.

Figure 12:
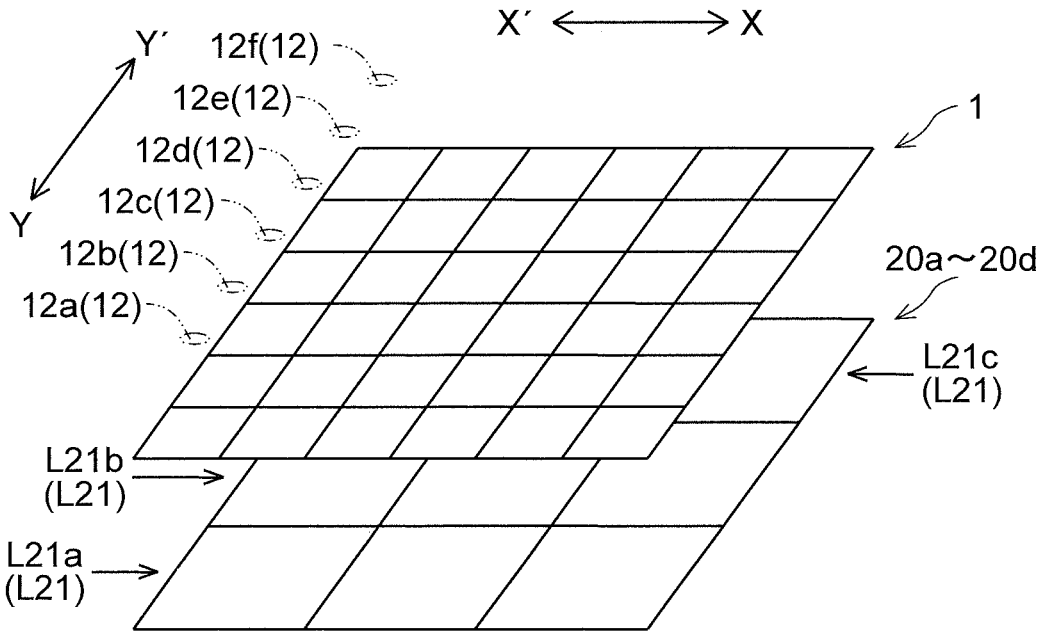
FIG. 12 is a diagram illustrating an example of a relationship between element arrays on the thermal head and ink discharge ports in the inkjet recording apparatus according to the one embodiment of the present disclosure.

Although, in FIGS. 7 to 11, to facilitate understanding, a plurality of element arrays L21 are shown to be arranged in the width direction (the direction indicated by allows Y and Y') such that they each correspond to one ink discharge port 12, as shown in FIG. 12, a plurality of element arrays L21 can be arranged in the width direction (the direction indicated by allows Y and Y') such that they each correspond to two or more (two in FIG. 12) ink discharge ports 12.

That is, an element array L21*a* can be arranged so as to correspond to ink discharge ports 12*a* and 12*b*, an element array L21*b* can be arranged so as to correspond to ink discharge ports 12*c* and 12*d*, and an element array L21*c* can be arranged so as to correspond to ink discharge ports 12*e* and 12*f*. In this case, for example, if at least one of ink discharge ports 12*a* and 12*b* performs ink discharge, the predetermined region (the heating region R21) of the element array L21*a* is made to generate heat.

In this embodiment, as described above, the thermal heads 20*a* to 20*d* are provided which are arranged opposite the ink discharge surfaces 11 of the recording heads 10*a* to 10*d* across the recording medium conveying passage 2 and which heat the recording medium 1. With this structure, compared with a structure where a heating device heating the recording medium 1 is arranged on the recording heads 10*a* to 10*d* side of the recording medium conveying passage 2, it is possible to prevent the recording heads 10*a* to 10*d* from receiving excess heat and thus to prevent the temperature of the recording heads 10*a* to 10*d* from increasing. Thus, it is possible to prevent the ink 50 in the ink discharge ports 12 of the recording heads 10*a* to 10*d* from drying to solidify, and thus it is possible to prevent the ink discharge ports 12 from being clogged up. As a result, it is possible to heat the ink 50 on the recording medium 1 while preventing the temperature of the recording heads 10*a* to 10*d* from increasing.

The control portion 110 can selectively make a plurality of the heating elements 21 generate heat and makes at least part of the heating elements 21 in the element arrays L21 that correspond to the ink discharge ports 12 that discharge ink generate heat. Thus, unlike when the whole thermal heads 20*a* to 20*d* are made to generate heat, it is possible to make only the necessary part (at least part of the heating elements 21 in the element arrays L21 that correspond to the ink discharge ports 12 that discharge ink) generate heat; thus it is possible to efficiently dry the ink 50 on the recording medium 1 with a small amount of heat generated and it is possible to further prevent the recording heads 10*a* to 10*d* from receiving excess heat.

The control portion 110 changes at least one of the amount of heat generated in the heating region R21 and the length of the heating region R21 in the recording medium conveying direction according to how quickly the ink 50 on the recording medium 1 dries. Accordingly, it is possible to dry the ink 50 on the recording medium 1 optimally and efficiently and it is possible to further prevent the recording heads 10*a* to 10*d* from receiving excess heat.

As described above, where a plurality of the recording heads 10*a* to 10*d* are arranged along the recording medium conveying direction, it is possible to dry the ink 50 on the recording medium 1 discharged from the recording heads 10*a* to 10*d* in some degree (preliminarily drying) with the thermal heads 20*a* to 20*d* before the ink 50 reaches the following recording heads 10*b* to 10*d* or the conveying roller pair 6. Thus, it is possible to prevent the ink 50 from mixing among different colors and attaching to the conveying roller pair 6, and thus it is possible to prevent image quality from deteriorating.

As described above, the control portion 110 can change at least one of the amount of heat generated in the heating region R21 and the length of the heating region R21 in the recording medium conveying direction according to the amount of ink discharged from the ink discharge ports 12. With this structure, it is possible to easily dry the ink 50 on the recording medium 1 optimally and efficiently.

As described above, the control portion 110 can change at least one of the amount of heat generated in the heating region R21 and the length of the heating region R21 in the recording medium conveying direction according to the type of the recording medium 1. With this structure, it is possible to easily dry the ink 50 on the recording medium 1 optimally and efficiently.

As described above, as shown in FIGS. 7 and 8, the control portion 110 can make the heating elements 21 generate heat with the heating region R21 kept at rest at a predetermined position and change the amount of heat generated in the heating region R21 according to how quickly the ink 50 on the recording medium 1 dries.

As described above, as shown in FIG. 9, the control portion 110 can form the heating region R21 such that it extends in the recording medium conveying direction, make the heating elements 21 generate heat with the heating region R21 kept at rest at a predetermined position, and change the length of the heating region R21 in the recording medium conveying direction according to how quickly the ink 50 on the recording medium 1 dries. With this structure, the time required for the ink 50 on the recording medium 1 to pass across the heating region R21 can be made longer, and thus it is possible to lower the set temperature of the heating region R21 (to lower the temperature of the top face of the recording medium 1). Accordingly, even when the recording medium 1 has competitively low heat resistance, it is possible to prevent the recording medium 1 from suffering heat distortion.

As described above, as shown in FIGS. 10 and 11, the control portion 110 can make the heating region R21 move toward the downstream side in the recording medium conveying direction with the movement of the ink 50 on the recording medium 1 and change the amount of heat generated in the heating region R21 according to how quickly the ink 50 on the recording medium 1 dries. With this structure, the time required for the ink 50 on the recording medium 1 to pass across the heating region R21 can be made longer, and thus it is possible to lower the set temperature of the heating region R21 (to lower the temperature of the top face of the recording medium 1). Accordingly, even when the recording medium 1 has competitively low heat resistance, it is possible to prevent the recording medium 1 from suffering heat distortion.

With this structure, compared with a structure where the heating region R21 is formed such that it extends in the recording medium conveying direction (a case in FIG. 9), it is possible to efficiently dry the ink 50 on the recording medium 1 with a smaller amount of heat generated and further prevent the recording heads 10*a* to 10*d* from receiving excess heat.

The embodiments disclosed herein should be understood to be in every respect illustrative and not restrictive. The scope of the present disclosure is not defined by the description of embodiments given above but by the appended claims, and encompasses any modifications made in the sense and scope equivalent to those of the claims.

For example, although the embodiments described above deal with an example where a recording medium 1 in a roll is used, this is not meant to limit the present disclosure; instead, a recording medium 1 cut to a predetermined size (for example, A4 size) may be used.

Although the embodiments described above deal with an example where aqueous ink is used, this is not meant to limit the present disclosure; instead, non-aqueous ink such as organic solvent ink may be used.

Although the embodiments described above deal with an example where a slide layer 41 formed of, for example, a glass plate is provided on the top face of the thermal heads 20*a* to 20*d*, this is not meant to limit the present disclosure. Instead, a slide layer 41 may be provided by coating the top face of the thermal heads 20*a* to 20*d* with fluorine resin or the like.

Figure 13:
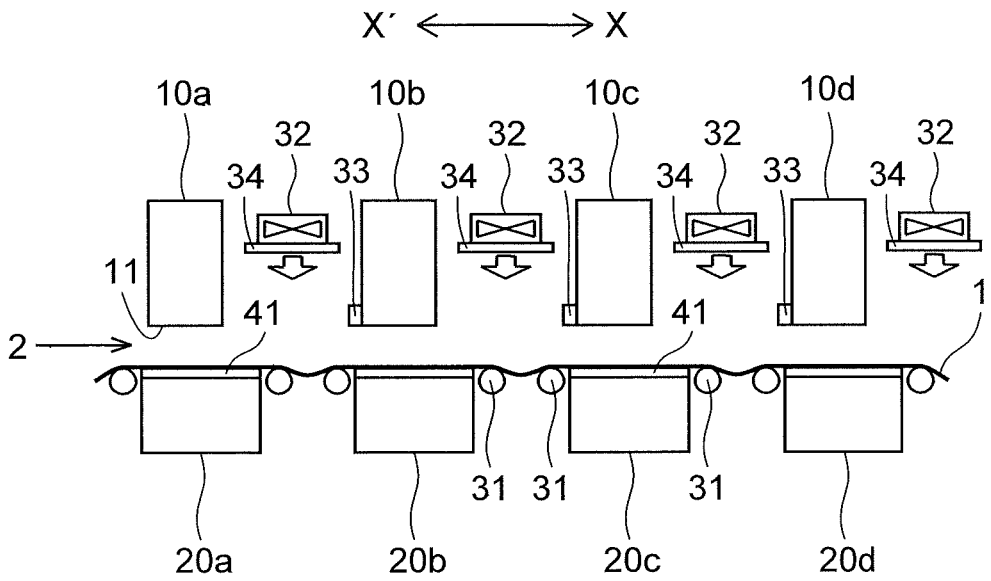
FIG. 13 is a diagram showing a structure of and around recording heads and thermal heads in an inkjet recording apparatus according to a modified example of the present disclosure, showing a structure provided with an auxiliary heating device heating a recording medium from the top face side.

Although the embodiments described above deal with an example where the recording medium 1 is heated only from the reverse face side by use of the thermal heads 20*a* to 20*d*, this is not meant to limit the present disclosure. For example, as in an inkjet recording apparatus 100 of a modified example according to the present disclosure as shown in FIG. 13, in addition to the thermal heads 20*a* to 20*d*, an auxiliary heating device 34 may be provided which supplementarily heats the recording medium 1 from the top face side. Also in this case, compared with a structure where a recording medium is heated only from the top face side, it is possible to prevent the temperature of the recording heads 10*a* to 10*d* from increasing. A suitable example of using the auxiliary heating device 34 is, for example, a case where the auxiliary heating device 34 is supplementarily used at a temperature lower than the thermal heads 20*a* to 20*d* because, to print on a recording medium 1 having low heat resistance such as PP, the thermal heads 20*a* to 20*d* cannot be made to generate heat sufficiently.

Although the embodiments described above deal with an example where a plurality of recording heads 10*a* to 10*d* are provided along the recording medium conveying direction, this is not meant to limit the present disclosure; instead, only one recording head may be provided along the recording medium conveying direction.

Although the embodiments described above deal with an example where, when the control portion 110 changes at least one of the amount of heat generated in the heating region R21 and the length of the heating region R21 according to the type of the recording medium 1, the control portion 110 changes at least one of the amount of heat generated in the heating region R21 and the length of the heating region R21 changed according to a thickness of the recording medium 1, this is not meant to limit the present disclosure. Instead, the control portion 110 can change at least one of the amount of heat generated in the heating region R21 and the length of the heating region R21 according to the material (heat conductivity) of the recording medium 1.

Although the embodiments described above deal with an example where supporting members 31 are provided on the upstream and downstream sides of the thermal heads 20*a* to 20*d* in the recording medium conveying direction, this is not meant to limit the present disclosure; instead, no supporting member 31 needs to be provided.

Although the embodiments described above deal with an example where a slide layer 41 is provided on the top face of the thermal heads 20*a* to 20*d*, this is not meant to limit the present disclosure; instead, no slide layer 41 needs to be provided on the top face of the thermal heads 20*a* to 20*d*.

What is claimed is:

1. An inkjet recording apparatus comprising:

a recording head having an ink discharge surface in which a plurality of ink discharge ports discharging ink onto a recording medium are open;

a thermal head arranged opposite the ink discharge surface across a recording medium conveying passage, the thermal head heating the recording medium; and a heat control portion controlling the thermal head;

wherein the thermal head is provided with a plurality of element arrays in a width direction perpendicular to a recording medium conveying direction, the element arrays each being formed of a plurality of heating elements arrayed in the recording medium conveying direction, the element arrays each corresponding to one or more of the ink discharge ports, the element arrays are arranged at least on a downstream side, in the recording medium conveying direction, of a landing position where the ink discharged from the ink discharge ports lands on the recording medium, the heat control portion can make the plurality of heating elements generate heat selectively, makes at least part of the heating elements in the element arrays that correspond to the ink discharge ports that discharge ink generate heat, and changes at least one of an amount of heat generated in a heating region in which the heating elements in the element arrays are made to generate heat and a length of the heating region in the recording medium conveying direction according to how quickly the ink on the recording medium dries.

2. The inkjet recording apparatus according to claim 1, wherein a plurality of the recording heads and a plurality of the thermal heads are provided along the recording medium conveying direction.

3. The inkjet recording apparatus according to claim 1, wherein the heat control portion changes at least one of the amount of heat generated in the heating region and the length of the heating region in the recording medium conveying direction according to an amount of ink discharged from the ink discharge ports.

4. The inkjet recording apparatus according to claim 1, wherein the heat control portion changes at least one of the amount of heat generated in the heating region and the length of the heating region in the recording medium conveying direction according to a type of the recording medium.

5. The inkjet recording apparatus according to claim 1, wherein the heat control portion makes the heating elements generate heat with the heating region kept at rest at a predetermined position, and changes the amount of heat generated in the heating region according to how quickly the ink on the recording medium dries.

6. The inkjet recording apparatus according to claim 1, wherein the heat control portion forms the heating region such that the heating region extends in the recording medium conveying direction, makes the heating elements generate heat with the heating region kept at rest at a predetermined position, and changes the length of the heating region in the recording medium conveying direction according to how quickly the ink on the recording medium dries.

* * * * *